US005588864A

United States Patent [19]

Lin

[11] Patent Number: 5,588,864

[45] Date of Patent: Dec. 31, 1996

[54] CONNECTION DEVICE OF A COMPUTER CONNECTOR

[76] Inventor: Chao-Tsung Lin, 1st Fl., No. 2, Alley 9, Lane 45, Pao-Hsin Road, Hsin-Tien, Taipei, Taiwan

[21] Appl. No.: 208,595

[22] Filed: Mar. 11, 1994

[51] Int. Cl.[6] ..... H01R 13/627

[52] U.S. Cl. ..... 439/357

[58] Field of Search ..... 439/350–355, 439/357, 358

[56] References Cited

U.S. PATENT DOCUMENTS

| | | | |
|---|---|---|---|
| 4,961,711 | 10/1990 | Fujiura et al. | 439/357 |
| 5,011,424 | 4/1991 | Simmons | 439/357 |
| 5,178,556 | 1/1993 | Chen | 439/357 |
| 5,201,669 | 4/1993 | Lin | 439/357 |

*Primary Examiner*—Hien D. Vu
*Attorney, Agent, or Firm*—Pro-Techtor International

[57] ABSTRACT

Disclosed is an improved connection device of a computer connector, comprising a clip piece including a metal leaf spring and a press cap fixed to a top of the metal leaf spring, and an insertion socket provided in a clip room formed at one side of an inner shell of said connector; the metal leaf spring of the clip piece having a bottom end formed with two hooks for firmly hooking on a head portion of a connector on the computer; the connection device being characterized by that the insertion socket is formed from a middle portion of a side wall of the inner shell which upward and inward projects toward the connector, forming an insertion plate and an insertion opening over said insertion plate, that a through hole is provided above the insertion opening, and a stop plate is formed between the through hole and the insertion opening, and that the clip piece has an inwardly protruded ⌈-shaped hooking plate formed at a predetermined position corresponding to the insertion plate, such that when the clip piece is inserted into the insertion socket, the hooking plate thereof extends into and through the through hole and the insertion opening, causing the clip piece to be directly clamped in place between the insertion plate and the stop plate.

1 Claim, 5 Drawing Sheets

CONNECTION DEVICE OF A COMPUTER CONNECTOR

BACKGROUND OF THE INVENTION

1. Field of the Invention

The present invention relates to a connection device of a computer connector, and more particularly to one which has clip pieces located in the shell of the connector.

2. Description of the Prior Art

The present invention relates to a connection device of a computer connector.

Conventional connection mechanism of a computer connector, such as that shown in FIG. 1, is still unsatisfactory in the respect of assembly, production, maintenance and replacement.

Referring to FIG. 1, in the conventional connection structure of computer connectors, a hole is punched in the middle section of the fixing plate 203. An upward protruding hooked stud 201*c* on the side wall of the inner shell 201 of the connector 200 is inserted into this hole. The fixing plate 203 corresponds to the clip socket 301 of the computer. At the bottom of the fixing plate 203, the hook 203*b* can grasp the hook piece 302, 303 of the clip socket 301 to get a locking effect. Accordingly, the computer connector 200 will not detach from the clip socket 301 connected. But while the operator presses the press-board 203*a* of the connector 200 lightly, the above locking effect will disappear at once.

However, said connection construction of a computer connector has the following inconvenience in use: said fixing plate 203 is fixed to the upward protruding hooked stud 201*c* on the inner shell 201 of the connector by only one fulcrum, and after long term of use, the hooked stud 201*c* is easy to detach from the fixing plate 203 in the course of use or assembly due to metal fatigue.

An improved connection device of a computer connector was disclosed in the U.S. Pat. No. 5,201,669 granted to the same inventor on Apr. 13, 1993. This improved and patented connection device of computer connector consists of a clip piece formed from a metal leaf spring and a press button fixed to a top of the leaf spring, and a strip-like insertion socket formed at a clip room at a lateral side of the shell of the connector. The metal leaf spring of the clip piece is stamped to form at its middle portion two corresponding projected hooked studs so that the clip piece may extend through a plate recess of the insertion socket and retained in the latter. The metal leaf spring of the clip piece has a claw hook formed at its free end for hooking to a head portion of the computer connector. The other end of the leaf spring of the clip piece is fixedly covered by the press button.

Although the connection device of a computer connector disclosed in the U.S. Pat. No. 5,201,669 is found, after long term of use, to have the advantages of speedy manufacture and assembly, easy maintenance, and wide range of applications, it is nevertheless found to have other shortcomings, such as that the strip-like insertion socket is so formed that it projects outward and has a retaining hole which prevents the clip piece from tightly engaging with the insertion socket because the two hooked studs shall project inward when the clip piece is inserted into the insertion socket, and that since extra clearance will be formed by this type of connection construction, when the press button is pressed and the two hooked studs of the clip piece inward project, the socket of the connector is interfered and the quality of connection is reversely affected.

In view that there are still shortcomings existed in the connection of the clip piece with the strip-like insertion socket as disclosed in the U.S. Pat. No. 5,201,669, the inventor keeps making extensive researches in improving it and finally created the construction of the present invention.

SUMMARY OF THE INVENTION

Thus, a primary object of the present invention is to provide a further improved connection device of a computer connector in which a clip piece with dual protruded hooking means is provided at each side of the inner shell of the connector so that when the clip piece is inserted into the strip-like insertion socket at each side of the connector, the protruded hooking means formed at the middle portion of the clip piece may quickly enable the clip piece to be firmly fixed to one side of the connector without the risk of easily detaching from the connector.

Another object of the present invention is to provide an improved connection device of a computer connector in which the clip piece is formed at its free end hooks to catch a clip socket of the computer, and at its another end a ρ-shaped or ρ-shaped configuration, depending on the type of the connector to be used, to fitly couple with the press cap so that any electric shock caused by dampness can be avoided.

A further object of the present invention is to provide an improved connection device of a computer connector in which the strip-like insertion sockets at two sides of the connector each has an insertion plate upward and inward projecting toward the connector, an insertion opening naturally formed over the insertion plate, a through hole form above the insertion plate, and a stop plate formed between the through hole and the insertion opening, such that the dual hooking means on the clip piece can be firmly retained by the stop plate.

BRIEF DESCRIPTION OF THE INVENTION

The detailed structure, the applied principle, and the action and effect of the present invention can be best understood through the following detailed description of the preferred embodiments and the accompanying drawings, wherein FIGS. 1 and 1A show different views of a conventional connector.

DETAILED DESCRIPTION OF THE PREFERRED EMBODIMENTS

Figure 1A:
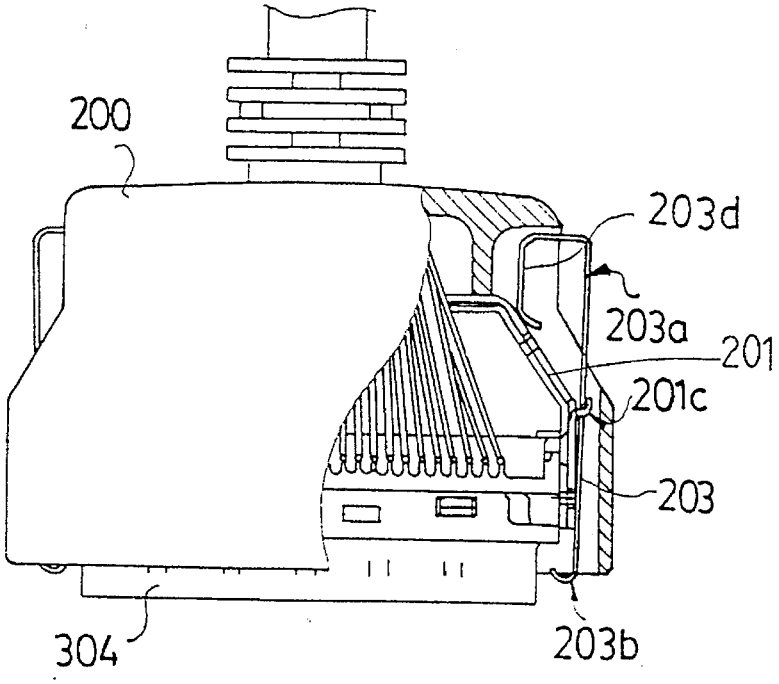
FIG.1A (PRIOR ART)
Figure 1:
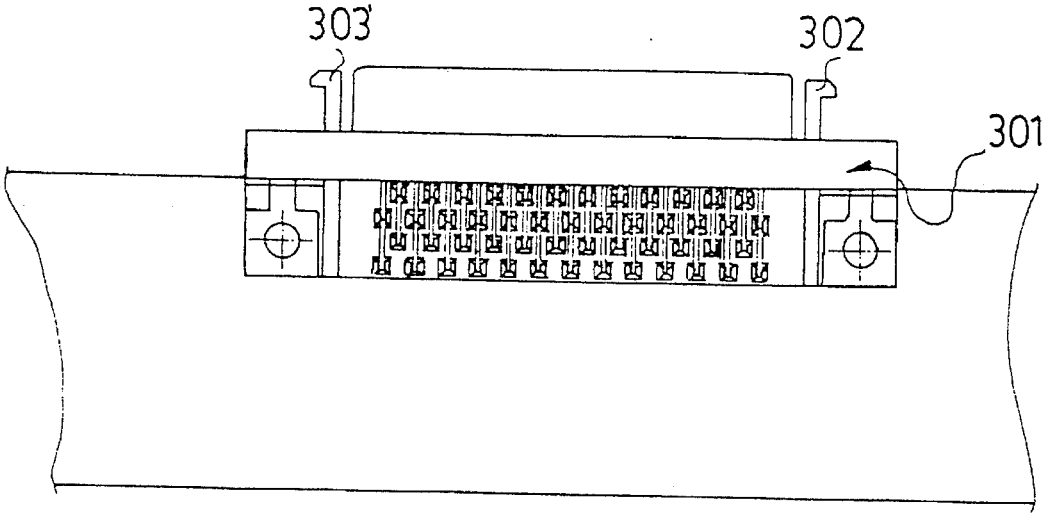
FIG.1 (PRIOR ART)
Figure 2A:
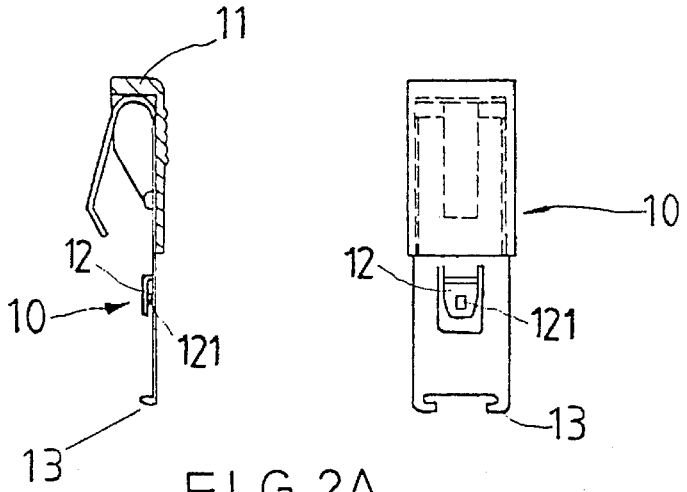
FIG. 2A shows a front and a side elevational views of the clip piece of the present invention.
Figure 2B:
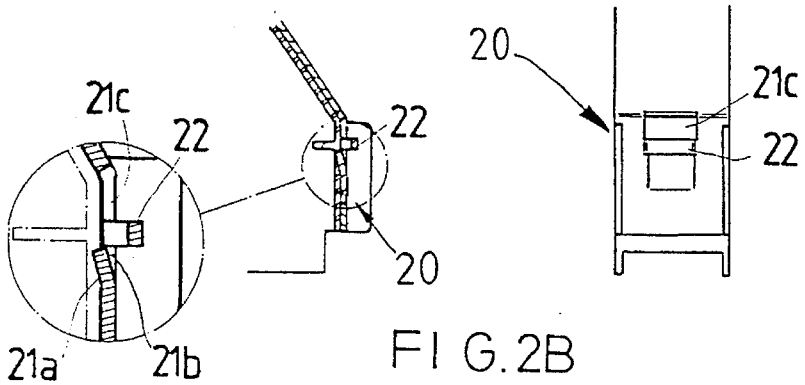
FIG. 2B shows a front and a side elevational views of the insertion socket of the present invention.
Figure 2C:
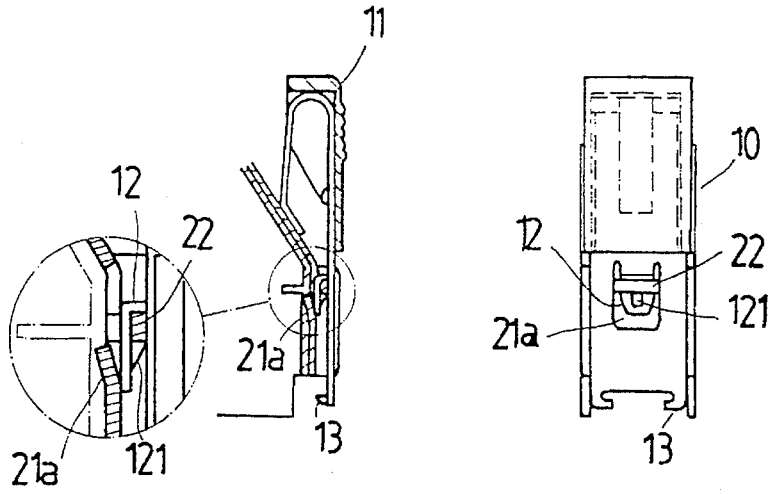
FIG. 2C shows the engagement of the clip piece and the insertion socket of the present invention from a front view and a side sectional view thereof.

Please refer to FIGS. 2A, 2B, and 2C, the present invention mainly includes a clip piece 10 and an insertion socket 20.

The clip piece 10 is substantially a metal leaf spring having a ⌈-shaped hooking plate 12 formed by stamping at a middle portion of the leaf spring such that the hooking plate 12 protrudes inward toward a back side of the clip piece 10. A detent 121 is further formed on a front or outer side of the hooking plate 12 at a predetermined position. The clip piece 10 has a top portion having a ρ-shaped or a ρ-shaped vertical section to fit with different connector body 200 and/or of a press cap 11 fixed to the top of the clip piece 10, and a bottom end having two hooks 13.

The insertion socket 20 is formed on the side wall of an inner shell of the connector body 200 and includes a striplike insertion plate 21*a* which is formed from a middle portion of the side wall of the inner shell upward and inward projecting toward the connector body 200, an insertion opening 21*b* naturally formed over the insertion plate 21*a*, a through hole 21*c* provided above the insertion opening 21*b*, and a stop plate 22 formed between the through hole 21*c* and the insertion opening 21*b*.

To assemble the computer connector body 200 fitted with the connection device of the present invention, first fix the inner shell with the insertion sockets 20 at two sides thereof to a terminal of the computer. Then, insert the clip pieces 10 down into the insertion sockets 20 so that the hooking plates 12 extend into and through the insert opening rib 21*b* and slide down along the insertion plates 21*a* until the detents 121 on the outer side of the hooking plates 12 pass and are retained by the stop plate 22. At this point, the hooking plates 12 are clamped in place between the insertion plates 21*a* and the stop plates 22. And, the assembly of the connection device with the computer connector is completed.

Figure 3:
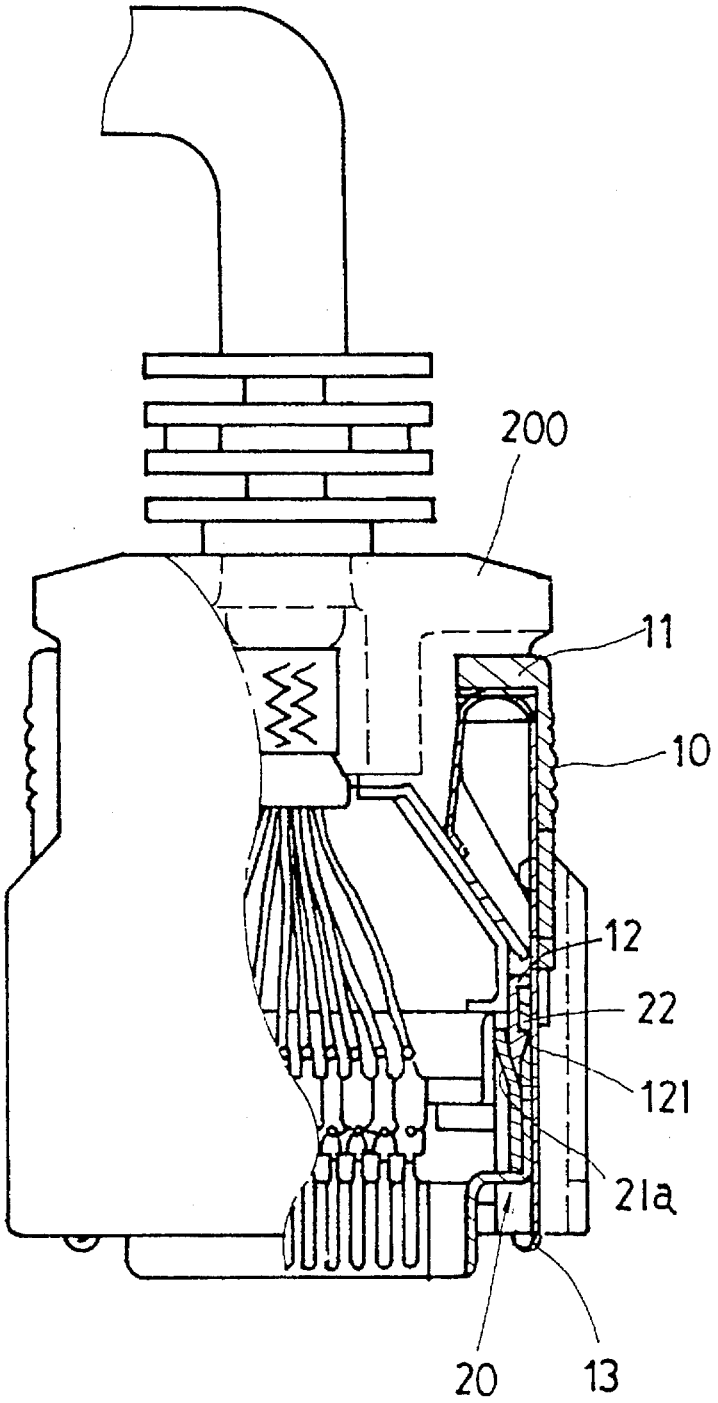
FIG. 3 is a partially vertical sectional view of a computer connector using a first embodiment of the present invention.
Figure 5:
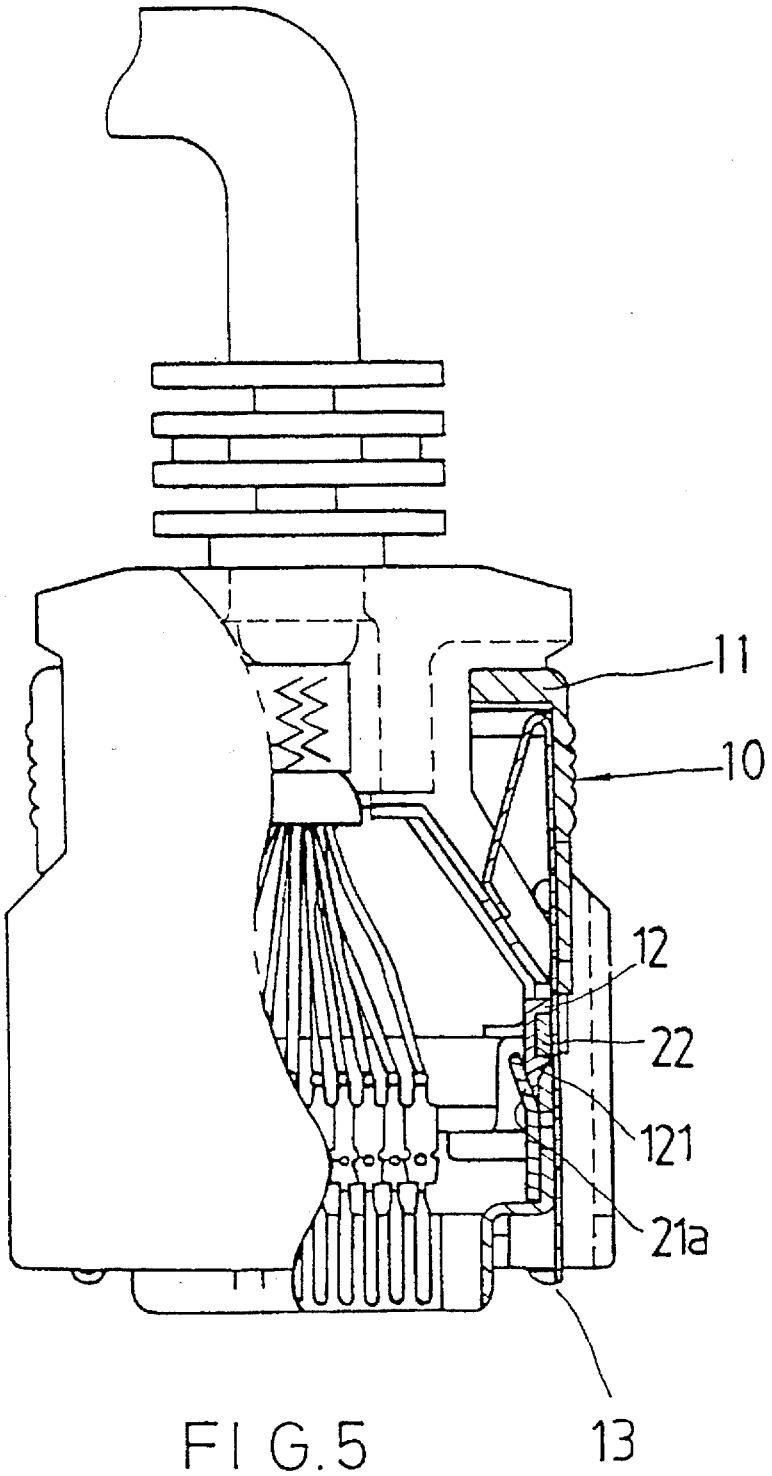
FIG. 5 is a partially vertical sectional view of a computer connector using a second embodiment of the present invention.

To operate the connection device, lightly press the press caps 11 of the clip pieces 10 with fingers, causing the clip pieces 10 to move toward the connector body 200. At this point, with the hooking plates 12 and the insertion plates 21*a* as the fulcrum, the bottom hooks 13 of the clip pieces 10 shall spring outward away from the connector body 200 (see FIGS. 3 and 5 for details). This allows the hooks 13 to detach from the terminal of computer which is originally clamped and hooked by the hooks 13.

Figure 4:
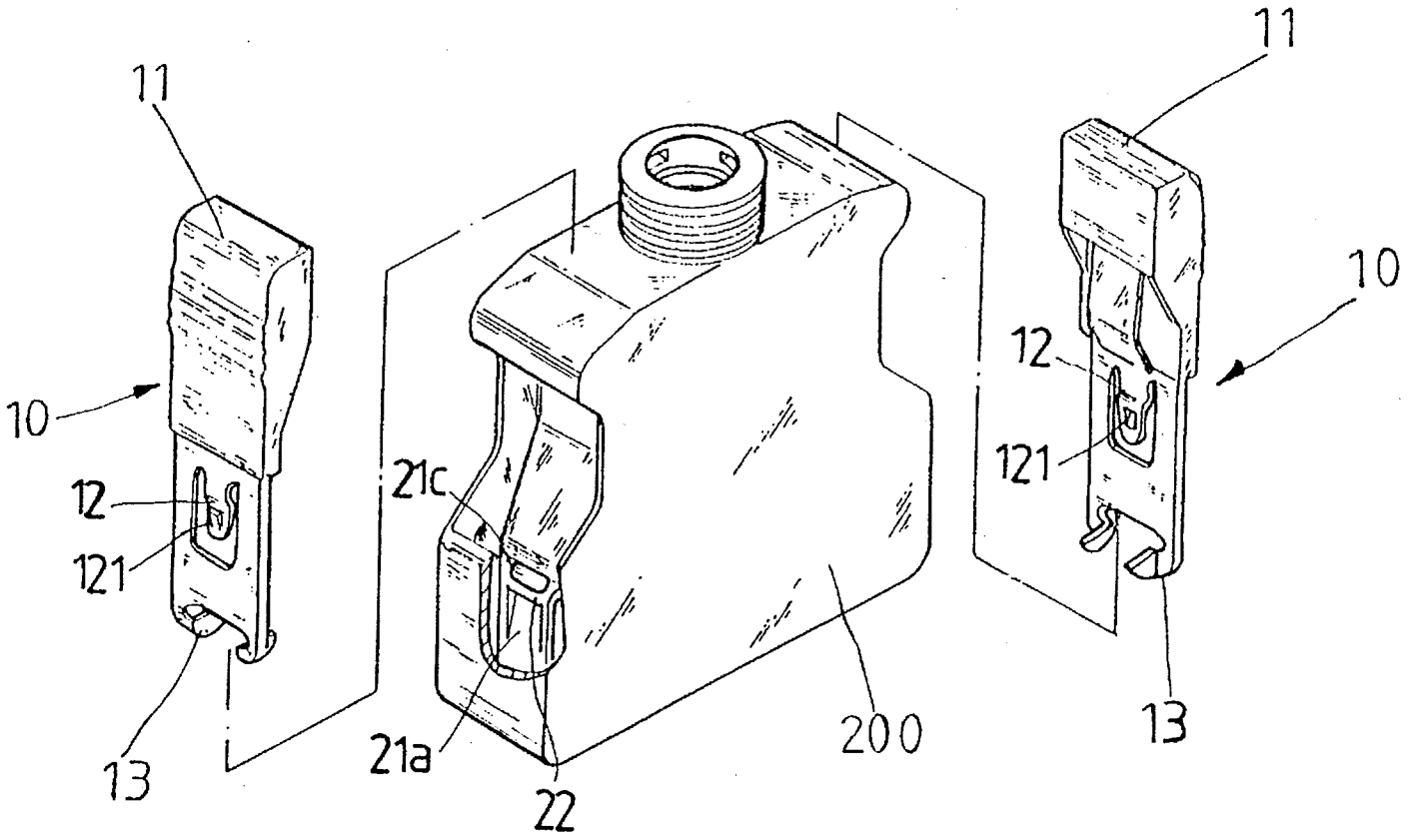
FIG. 4 is an exploded perspective showing a computer connector with the clip pieces and the insertion sockets according to the present invention.

FIG. 4 is an exploded perspective of the connection device of the present invention, from which the relative position of the clip pieces 10 to the connector body 200 and to the insertion sockets 20.

From the above description, the improved connection device of a computer connector provided by the present invention truly has better function, better safety in use, easier in manufacture, assembly, maintenance, and replacement, and can be used without the risk of unexpectedly detaching from the terminal of computer to which the connector is connected.

The present invention has been described in details with particular reference to the preferred embodiments thereof, but it will be understood that variations and modifications can be made within the spirit and scope of the present invention as described hereinabove and as defined in the appended claims.

What is claimed is:

1. A computer connector having a connection device, said connection device comprising:

a clip piece including a metal leaf spring and a press cap fixed to a top of the metal leaf spring, and an insertion socket formed at one side of an inner shell of said computer connector; said metal leaf spring of said clip piece having a bottom end formed with two hooks for firmly hooking on a head portion of a mating computer connector;

said insertion socket is formed at a middle portion of a side wall of said inner shell, wherein said insertion socket includes an insertion plate extending inwardly from an end of said middle portion of said side wall, a stop plate extending upwardly from said sidewall and defining an insertion opening above said insertion plate and a through hole adjacent to said insertion plate;

said clip piece has an inwardly protruding hooking plate at a position corresponding to said insertion plate, such that when said clip piece is inserted into said insertion socket, said hooking plate extends into said through hole and said insertion opening, causing said clip piece to be directly clamped in place between said insertion plate and said stop plate, and wherein said hooking plate includes a detent positioned thereon so that said chip piece is retained firmly in said insertion socket when said clip piece is fully inserted into said insertion socket.

* * * * *